US006913317B2

(12) United States Patent
Vanderminden et al.

(10) Patent No.: US 6,913,317 B2
(45) Date of Patent: Jul. 5, 2005

(54) ADJUSTABLE SWIVEL ROCKER

(75) Inventors: William M. Vanderminden, Granville, NY (US); Robert D. Vanderminden, Sr., Granville, NY (US)

(73) Assignee: Telescope Casual Furniture, Inc., Granville, NY (US)

( * ) Notice: Subject to any disclaimer, the term of this patent is extended or adjusted under 35 U.S.C. 154(b) by 0 days.

(21) Appl. No.: 10/178,998

(22) Filed: Jun. 25, 2002

(65) Prior Publication Data

US 2003/0234566 A1 Dec. 25, 2003

(51) Int. Cl.[7] ..... A47C 1/02

(52) U.S. Cl. ..... 297/344.24; 297/344.1; 297/344.21

(58) Field of Search ..... 297/302.1, 302.3, 297/325, 344.1, 344.21, 344.24, 303.1; 248/419, 423, 424, 429, 292.12

(56) References Cited

U.S. PATENT DOCUMENTS 1,491,918 A * 4/1924 Nolan ..... 297/295
2,141,262 A * 12/1938 Cole ..... 297/294
2,353,737 A * 7/1944 Lorenzo ..... 297/300.4
2,430,656 A * 11/1947 Wright ..... 248/419
2,699,200 A * 1/1955 Lingle ..... 297/294
4,114,947 A * 9/1978 Nelson ..... 297/344.1
4,456,298 A * 6/1984 Gottstein ..... 297/353
4,768,829 A * 9/1988 Goldman ..... 297/317
4,786,106 A * 11/1988 Bottemiller ..... 297/265.1
5,035,466 A * 7/1991 Mathews et al. ..... 297/337
5,039,164 A * 8/1991 Gibbs ..... 297/302.1
5,183,313 A * 2/1993 Cunningham ..... 297/344.1
5,599,064 A * 2/1997 Vanderminden, Sr. . 297/344.21
5,931,530 A * 8/1999 Liu ..... 297/270.3
6,296,313 B1 * 10/2001 Wu ..... 297/411.35

* cited by examiner

*Primary Examiner*—Peter M. Cuomo
*Assistant Examiner*—Stephen D'Adamo
(74) *Attorney, Agent, or Firm*—Francis C. Hand; Carella, Byrne, Bain, et al.

(57) ABSTRACT

The chair frame of a swivel rocker is slidably mounted via a pair of sleeves on the arms of a pair of flexures mounted on the base of the rocker to allow the chair frame to be moved into different positions on the flexures. Bolts are used to secure the sleeves in place on the flexures. Movement of the sleeves along the flexures changes the position at which the weight of an occupant is transferred to the flexures and thereby changes the bending moments imposed on the flexures.

2 Claims, 3 Drawing Sheets

ADJUSTABLE SWIVEL ROCKER

This invention relates to an adjustable swivel rocker. More particularly, this invention relates to an outdoor adjustable swivel rocker.

Heretofore, various types of chairs have been known which can be provided with swivel connections to allow a seated occupant to rotate about a vertical axis. In addition, several types of these chairs have been provided with a pivot mechanism which allows the back of the chair to be pivoted forwardly and backwardly relative to a fixed seat. Still other chairs have been known in which the seat and back of the chair can be rocked back and forth as a unit. This latter type of chair is generally classified as a swivel rocker.

Swivel rocker chairs have been particularly employed as casual furniture, for example, of the outdoor type such as described in U.S. Pat. No. 5,599,064.Typically, such swivel rocker chairs have been constructed of a chair frame that is mounted on a base for rocking back and forth against the force of one or more springs or flexures. In addition, the chairs have been constructed to accommodate a standard size of occupant. Thus, in the case of a heavier than standard occupant, a backward motion of the chair frame may overcome the biasing force of the spring or flexure to such an extent that the chair frame bottoms against the base. This, in turn, can cause discomfort to the occupant. In the case of a lighter than standard occupant, the rocking action of the chair frame on the base may be too stiff.

Accordingly, it is an object of the invention to provide a swivel rocker that can be adjusted to the weight of an occupant.

It is another object of the invention to accommodate different-sized occupants in a swivel rocker while retaining a soft rocking action.

It is another object of the invention to permit the adjustment of a spring biasing force in a rocker in a relatively simple manner.

Briefly, the invention is directed to a rocker having a base, a chair frame and a pair of parallel flexures for supporting the chair frame on the base for rocking in a vertical plane.

In accordance with the invention, means are provided for adjusting the position of the chair frame on the flexures relative to the base in order to change the biasing force exerted by the flexures when in use.

In one embodiment, the flexures and means for adjusting the position of the chair frame are incorporated in a connection unit for mounting the chair frame on the base. In this embodiment, the base, chair frame and connection unit may be made as separate units that can be assembled together.

The connection unit includes a pair of rods that are secured to and across the chair frame, for example, by welding to side arms of the chair frame.

The means for adjusting the position of the chair frame includes a pair of sleeves, each of which is secured perpendicularly of and to each rod of the connection unit and each of which telescopically receives a respective one of the flexures therein. In addition, securing means are provided with each sleeve for releasably securing each flexure in a respective sleeve in one of a plurality of positions.

In one embodiment, the securing means is in the form of a bolt that passes through a sleeve into threaded relation in a flexure. In this embodiment, the sleeve has an elongated slot through which the bolt passes. Upon threading of the bolt into the flexure, a head of the bolt comes into engagement with the sleeve to thereby lock the sleeve against movement relative to the flexure. The longitudinal extent of the slot in the sleeve determines the amount of movement that the sleeve may make on the flexure.

Each slot in a sleeve may also be provided with a plurality of spaced apart recesses for selectively receiving the head of the bolt in mating relation such that each recess is indicative of a position of securement of the sleeve to the flexure.

The adjustable rocker is constructed so that the chair frame may be moved relative to the base to accommodate different weights of occupants. Typically, for an average-sized person, the chair frame would be secured to the base with the bolts located in the two sleeves at an intermediate position of a respective slot, for example, as defined by the center-most recess in the slot of each sleeve.

Should the rocker require adjustment to receive a heavier weighted occupant, the bolts would be loosened to an extent to allow the sleeves and, thus, the chair frame, to be manually moved forwardly relative to the flexures and, thus, the base. In this way, the fulcrum arm of each flexure is made shorter. After the sleeves have been moved forwardly, for example with each bolt now located at a rearmost recess, the bolts are re-tightened to secure the chair frame in place. Should the occupant now rock the chair frame backwardly, the weight of the occupant is applied to the flexures on a shorter fulcrum arm. Thus, the bending moment on the flexures is reduced so that the biasing force of the flexures is able to prevent the chair frame from bottoming on the base.

In the event that the rocker is to be adjusted to a lighter weighted occupant, the sleeves are moved to a rear-most position so that the bolts move into a foremost recess. Should the occupant now rock the chair frame backwardly, the weight of the occupant is applied to the flexures on a longer fulcrum arm. Thus, the flexures can be deflected a greater amount to impart a softer rocking action.

In order to facilitate the adjustment of the chair frame, the securing bolts may be formed with a socket to receive a socket wrench that may be supplied with the rocker and which may be readily manipulated by a user.

These and other objects and advantages of the invention will become more apparent from the following detailed description taken in conjunction with the accompanying drawings wherein.

Figure 1:
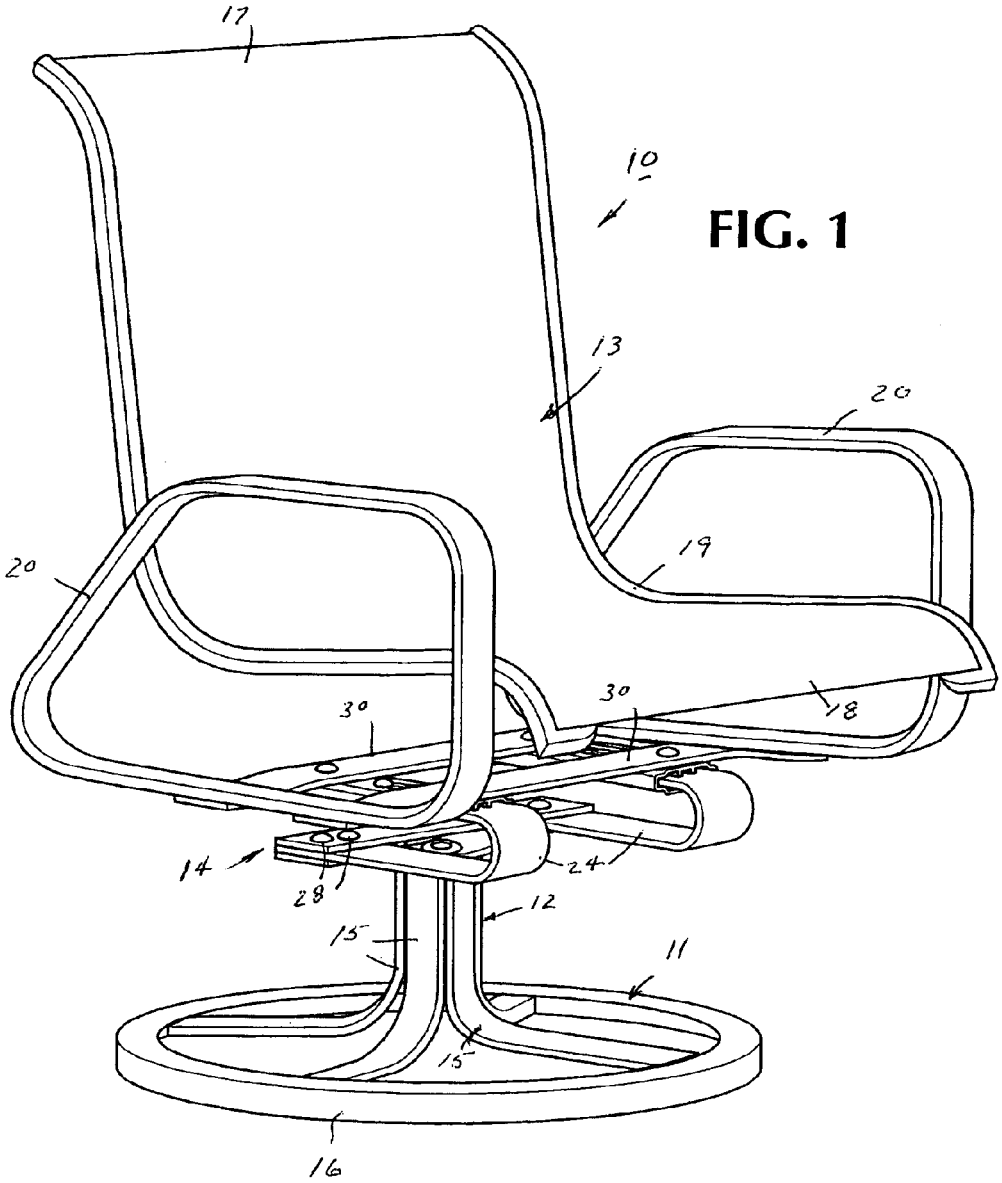
FIG. 1 illustrates a perspective front view of an adjustable swivel rocker constructed in accordance with the invention.

Referring to FIG. 1, the adjustable swivel rocker 10 is constructed of a base 11 having an upstanding stem 12, a chair frame 13 and a connection unit 14 connecting the chair frame 13 to the base 11.

Figure 4:
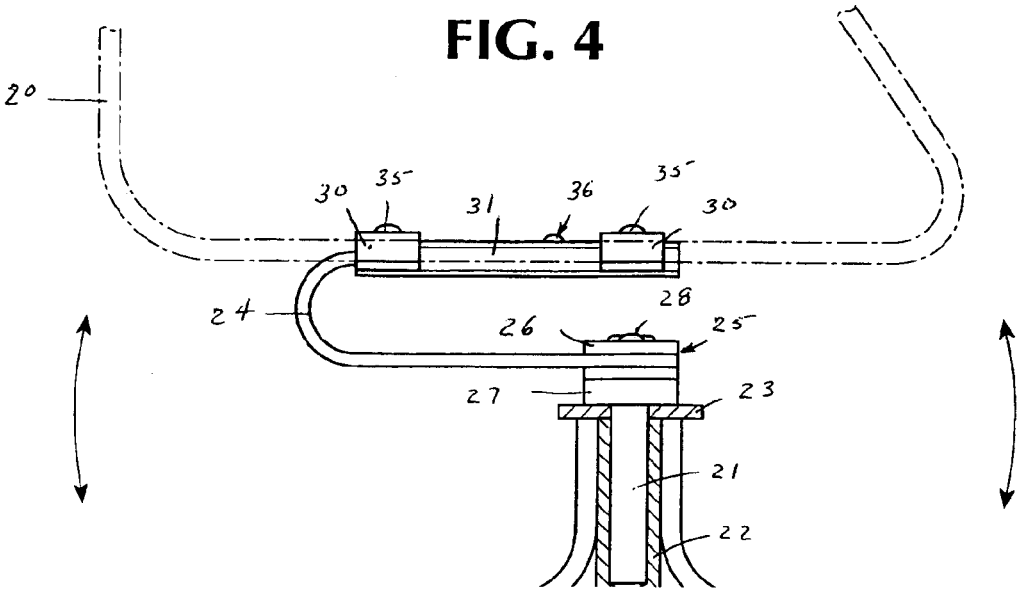
FIG. 4 illustrates a view taken on line 4—4 of FIG. 3 of the connection unit in place.

Referring to FIGS. 1 and 4, the base 11 is formed, for example, as described in U.S. Pat. No. 5,599,064, by four L-shaped legs 15 and a ring 16 secured to and about the legs 15. As illustrated, the legs 15 are disposed about a common vertical axis so that the legs 15, in part, define the upstanding stem 12. In the alternative, the base 11 may be made of any other suitable construction.

Referring to FIG. 1, the chair frame 13 includes a unit that forms a backrest 17 and a seat 18. This unit may include a metallic frame 19 across which a mesh fabric or the like is stretched to form the backrest 17 and seat 18. In addition, the chair frame 13 includes a pair of side arms 20, each of which is secured, as by welding, to the metallic frame 19 of the unit to form an integrated body. Each arm 20 may be hollow with a flattened cross-sectional shape.

Figure 2:
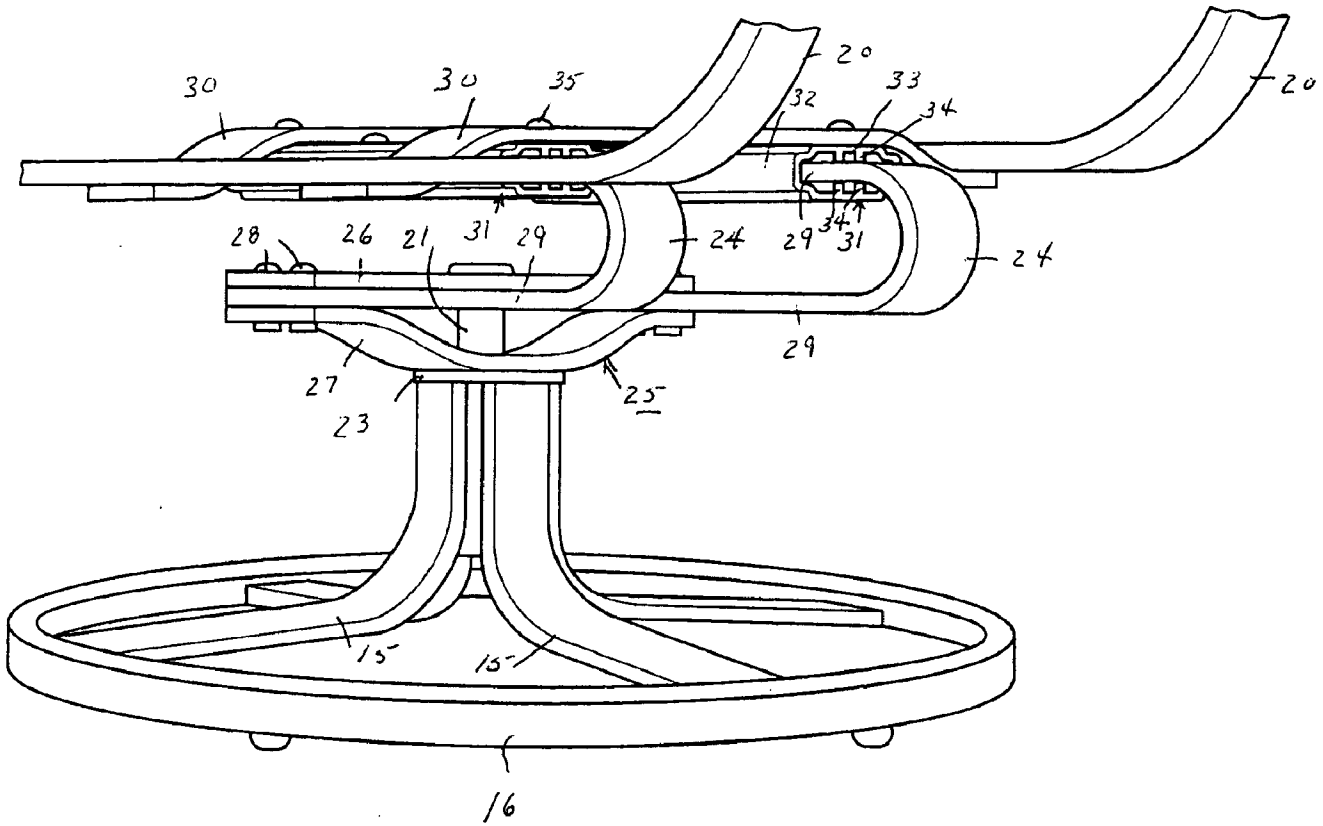
FIG. 2 illustrates a partial view of the adjustable swivel rocker of FIG. 1.

Referring to FIGS. 2 and 4, the connection unit 14 includes a hollow, vertical pivot pin 21 that is rotatably mounted within the stem 12 of the base 11. In this regard, the stem 12 is provided with a bearing sleeve 22, for example, of plastic to rotatably receive the pivot pin 21. The sleeve 22 may also be connected, as described in U.S. Pat. No. 5,599,064, to a bearing plate 23, for example, of plastic to receive the connection unit 14 thereon in bearing relation.

The connection unit 14 also includes a pair of U-shaped flexures 24 and a composite beam 25 that secures the flexures 24 with the pivot pin 21. As described in U.S. Pat. No. 5,599,064, the composite beam 25 is secured transversely of and to the pin 21 for pivoting therewith. In addition, the composite beam 25 is formed of a flat plate 26 and a contoured plate 27. The two plates 26, 27 sandwich one end of each flexure 24 therebetween. A pair of rivets 28 secure the plates 26, 27 and flexures 24 together.

Each flexure 24 is made, for example, of aluminum, and has a pair of legs 29 disposed in parallel, overlying relation. In addition, the flexures 24 face forwardly so that the free ends of the legs 29 are disposed rearwardly of the rocker 10. The flexures 24 serve to support the chair frame 13 on the base 11 for rocking in a vertical plane.

Figure 3:
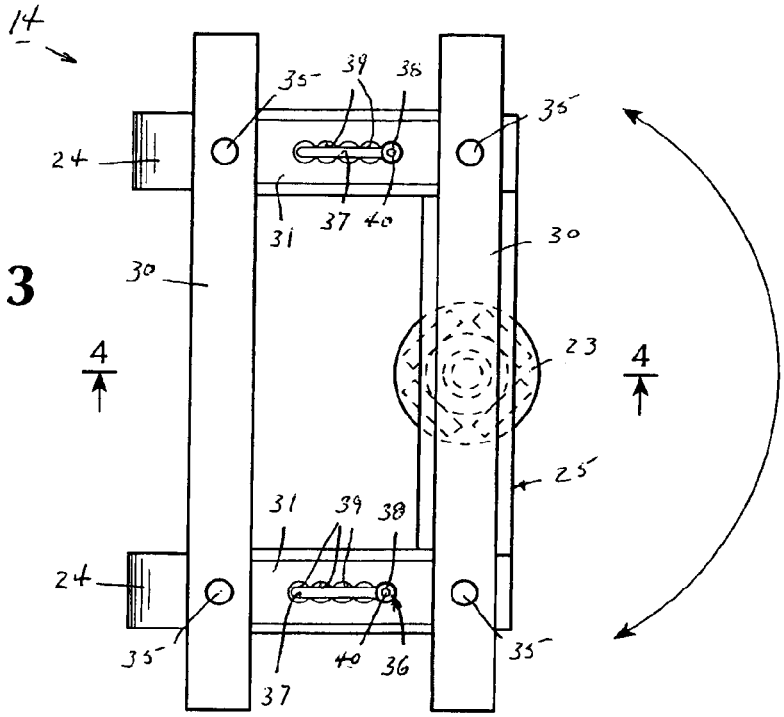
FIG. 3 illustrates a plan view of the connection unit of the adjustable swivel rocker in accordance with the invention.

Referring to FIGS. 2, 3, and 4, the connection unit 14 also includes a pair of support rails 30 of flattened shape, that are secured across the two side arms 20 of the chair frame 13. For example, as illustrated in FIG. 1, each support rail 30 is secured, as by welding, to the side-arms 20.

Referring to FIGS. 3 and 4, a means is provided for horizontally adjusting the position of the chair frame 13 on the flexures 24 relative to the base 11. As illustrated, this means includes a pair of sleeves 31, each of which is secured perpendicularly of and to each rail 30 to telescopically receive the upper arm 29 of a respective flexure 24.

As illustrated in FIG. 2, each sleeve 31 is of generally rectangular shape and has two parallel side walls 32 each of which defines a rectangular-shaped slot to slideably receive the arm 29 of a flexure 24 in a slide-fit manner. The remaining central section 33 of each sleeve 31 is of larger, rectangular cross-sectional shape with the roof and floor being provided with a pair of parallel ribs 34. These ribs 34 serve to support the chair frame 13 on the arms of the flexures within a minimum of surface area of contact thereby limiting the frictional surface of contact between each sleeve 31 and an arm 29 of a flexure 24. The ribs 34 also provide for a smooth sliding of the chair frame 13 on the flexures 24.

Referring to FIGS. 3 and 4, each sleeve 31 is secured to the cross-rails 30 by means of rivets 35. The enlarged central section of the sleeve 31 provides added space to accommodate the rivets 35. The underside of each sleeve 31 is provided with a assembly apertures (not shown) to facilitate fixation of a rivet 35 in place.

Referring to FIG. 3, a securing means is also provided for releaseably securing each flexure 24 in a respective sleeve 31, for example, in a selected one of a plurality of positions. To this end, the securing means is in the form of a bolt 36 that passes through an elongated slot 37 in a sleeve 31 into threaded engagement with a flexure 24. Upon threading of the bolt 36 into the upper arm 29 of a flexure, a head 38 of the bolt comes into engagement with the sleeve 31 to secure the sleeve 31 to the flexure 24. Typically, the slots 37 are sized to allow adjustment of the chair frame 13 over a distance of 2 inches. However, the adjustment may be more or less.

In addition, each slot 37 has a plurality of aligned recesses 39, each of which is sized to receive the head 38 of the bolt 36 in mating relation in order to provide a predetermined position of the chair frame 13 on the base 11. The recesses 39 in the slots 37 also allow the chair frame 13 to be aligned relative to the flexures 24. This avoids the possibility that the chair frame 13 might be skewed relative to the flexures 24, as might be the case, if the bolts 36 were secured in place at different random positions along the slots 37 relative to each other.

Each bolt 36 is of a threaded length sufficient to remain in threaded engagement with a respective flexure 24 with the head 38 out of mating engagement with the sleeve 31 to allow the sleeve 31 to be moved relative to the flexure 24. Thus, there is no need to remove the bolt 36 from the sleeve 31 to allow movement of the sleeve 31 along the flexure 24. Further, as the bolts 36 are to remain in place even in the partially threaded positions, the bolts 36 act as stops to block the chair frame 13 from sliding off the flexures 24.

In order to facilitate threading and unthreading of a bolt 36, the head 38 of the bolt 36 is provided with a socket 40, for example, to receive an Allen-type socket wrench.

Referring to FIG. 4, when the sleeves 31 are in a forward-most position, each bolt 36 is positioned in the rearmost recess 39 of a slot 37. In this position, the weight of an occupant is applied to the flexures on the shortest fulcrum. That is to say, the weight of the occupant is transferred to the flexures on the shortest lever arm. Thus, the bending moment caused by the occupant on the flexures is less so that the biasing force of the flexures is not exceeded. Accordingly, as a heavy occupant rocks backwardly in the chair frame 13, the free end of the top arm 29 of each flexure 24 deflects downwardly towards the composite beam 25 without coming into contact with the composite beam 25.

In order to adjust the chair frame for a lighter weighted occupant, the two bolts 36 are unthreaded to an extent that the heads 38 of the bolts 36 clear the slots 37 of the sleeves 31. At this time, the sleeves 31 are free to move along the flexures 24, for example, into an intermediate position or a rearmost position. The bolts 36 may then be rethreaded into the flexures 24 so that the heads 38 of the bolts 36 are received in the intermediate recess 39 of each slot 37 in order to secure the sleeves 31 to the flexures 24.

For a lightest-weighted occupant, the sleeves 31 are moved to the rearmost position with the bolt heads 38 in a foremost recess 39. In this position, the weight of the occupant is applied to the flexures 24 at the longest lever arm. When the lightest-weighted occupant rocks the chair frame 13 backwardly, the flexures 24 are able to flex to provide a soft rocking action.

In other embodiments, the flexures may be other than U-shaped. For example, the flexures may be of a flat leaf-type.

Further, the securing means for securing a flexure in a sleeve may be other than a threaded bolt. For example, a spring mounted pin may be provided in a sleeve to be received in a selected hole or recess within a flexure.

The invention thus provides an adjustable swivel rocker that can be adjusted to accommodate the weight of an occupant.

Further, the invention provides a relatively simple construction to adjust a rocker to accommodate the weight of different occupants.

What is claimed is:

1. An adjustable swivel rocker comprising a base having an upstanding stem;

a chair frame; and a connection unit connecting said chair frame to said base; said connection unit including a vertical pivot pin rotatably mounted in said stem of said base for rotatably supporting said chair frame on said base, a pair of parallel flexures secured between said base and said chair frame for supporting said chair frame on said base for rocking in a vertical plane, and means for horizontally adjusting the position of said chair frame on said connection unit relative to said base, said means including a pair of sleeves, each said sleeve telescopically receiving a respective one of said flexure therein; and securing means for releasably securing each respective flexure in a respective sleeve in a selected one of a plurality of positions, each said sleeve having a slot with a plurality of aligned recesses therein and said securing means is bolt passing through said respective sleeve and threaded into said respective flexure and having a head received in mating relation in a selected one of said recesses.

2. An adjustable swivel rocker comprising a base having an upstanding stem;

a chair frame, and a connection unit connecting said chair frame to said base; said connection including a vertical pivot pin rotatably mounted in said stem of said base for rotatably supporting said chair frame on said base, a pair of parallel flexures secured between said base and said chair frame for supporting said chair frame on said base for rocking in a vertical plane, and means for horizontally adjusting the position of said chair frame on said connection unit relative to said base, said means including a pair of sleeves, each said sleeve telescopically receiving a respective one of said flexures therein; and securing means for releaseably securing each respective flexure in a respective sleeve in a selected one of a plurality of positions, wherein each said sleeve has a pair of ribs therein for slidably mounting said respective sleeve on a respective flexure.

* * * * *

UNITED STATES PATENT AND TRADEMARK OFFICE

CERTIFICATE OF CORRECTION

PATENT NO. : 6,913,317 B2
DATED : July 5, 2005
INVENTOR(S) : William M. Vanderminden et al.

It is certified that error appears in the above-identified patent and that said Letters Patent is hereby corrected as shown below:

Column 5,
Line 12, "flexure" should be -- flexures --.
Line 17, "is bolt" should read -- is a bolt --.

Column 6,
Line 4, "connection" should be -- connection unit --.

Signed and Sealed this

Thirteenth Day of September, 2005

JON W. DUDAS
*Director of the United States Patent and Trademark Office*